US007285028B1

(12) United States Patent
Yang et al.

(10) Patent No.: US 7,285,028 B1
(45) Date of Patent: Oct. 23, 2007

(54) PLUG CONNECTOR

(75) Inventors: Mei-Chuan Yang, Tu-Cheng (TW); Chung-Hsin Huang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/434,239

(22) Filed: May 16, 2006

(51) Int. Cl.
*H01R 13/24* (2006.01)

(52) U.S. Cl. ..... 439/824

(58) Field of Classification Search ..... 439/271, 439/824

See application file for complete search history.

(56) References Cited

U.S. PATENT DOCUMENTS 5,859,961 A * 1/1999 Proebsting ..... 714/8

* cited by examiner

*Primary Examiner*—Briggitte R. Hammond
(74) *Attorney, Agent, or Firm*—Birch, Stewart, Kolasch & Birch, LLP

(57) ABSTRACT

A plug connector includes an insulative housing and a plurality of spring contacts retained therein. The insulative housing has a front face, a first mating face protruding from the front face, a plurality of passages extending rearwards from the first mating face for receiving a respective spring contact therein and a locking member secured in the insulative housing. The locking member has a second mating face abutting against the first mating face, a locking arm projecting forwards from the second mating face, and a pad positioned on the second mating face beside the locking arm. The shape of the gap between the plug connector and receptacle connector can be changed by adjusting the thickness of the pad. Properly, the gap is shaped to be a rectangle, so that the spring contact is provided with sufficient normal force to obtain a stable connection.

9 Claims, 8 Drawing Sheets

PLUG CONNECTOR

BACKGROUND OF THE INVENTION

1. Field of the Invention

The present invention is generally relative to a plug connector, more particularly, relative to a plug connector containing a plurality of spring contacts.

2. The Related Art

Plug connector is widely used for making electrical connection with electronic devices such as portable phone, notebook computer and PDA, etc.

Referring to FIG. 8 and FIG. 9, a conventional plug connector 300 and a complementary receptacle connector 400 are shown. The plug connector 300 includes an insulative housing 30*a* and a plurality of spring contacts 20*a* retained in the insulative housing 30*a*. The insulative housing 30*a* has a front face 31*a*, a mating face 15*a* protruding forwards from the front face 31*a* and a locking arm 13*a* projecting forwards from the mating face 15*a*.

After inserting the locking arm 13*a* into the receptacle connector 400, the spring contact 20*a* is compressed and resists against the receptacle connector 400. The plug connector 300 acts as a lever and the locking arm 13*a* functions as a pivot of the lever. The plug connector 300 swings around the locking arm 13*a* relative to the receptacle connector 400 under the elasticity of the spring contact 20*a*. As a result, an irregular gap 70 is formed between the plug connector 300 and the receptacle connector 400. Consequently, the plug connector 300 is connected with the receptacle connector 400 in a slanting direction and the spring contact 20*a* has insufficient normal force to resist against the receptacle connector 400. That will lead to an unstable connection between the plug connector 300 and the receptacle connector 400.

SUMMARY OF THE INVENTION

Accordingly, an object of present invention is to provide a plug connector to stably engage with a receptacle connector.

To achieve the above object, a plug connector is provided, which includes an insulative housing and a plurality of spring contacts retained therein. The insulative housing includes a front face, a plurality of lateral faces extending from the front face and end up with a rear face, a first mating face protruding from the front face, a plurality of passages extending from the first mating face throughout the insulative housing for receiving the respective contact therein and a locking member secured in the insulative housing. More particularly, the locking member has a second mating face which covers on the front face of the insulative housing and abuts against the first mating face, a locking arm projecting from the second mating face and a pad positioned on the second mating face beside the locking arm.

After inserting the locking arm into the receptacle connector, the first mating face bounds back under the elasticity of the spring contact and forms a first gap to the receptacle connector. In another hand, the pad is positioned between the second mating face of the plug connector and the receptacle connector keeping a second gap therebetween. So that, the first gap and the second gap constitute a gap between the mating face and the receptacle connector. Obviously, the plug connector acts as a lever and the locking arm function as a pivot of the lever. The plug connector swings around the locking arm relative to the receptacle connector. Therefore, when the plug connector is properly connected to the receptacle connector, the shape of the gap between the plug connector and the receptacle connector can be changed by adjusting the thickness of the pad. In order to achieve a considerable electrical connection between the plug connector and receptacle connector, the gap is shaped to be a rectangle. So that, the gap looks tidy. Further more, the plug connector is able to be inserted into the receptacle connector straightly, consequently, the spring contacts are provided with sufficient normal force to resiliently contact the respective respectable contacts and effect a stable electrical communication therebetween.

These and other features, objects and advantages of the present invention will be more fully apparent from the following detailed description set forth below when taken in conjunction with the accompanying drawings.

DETAILED DESCRIPTION OF THE PREFERRED EMBODIMENT

Figure 1:
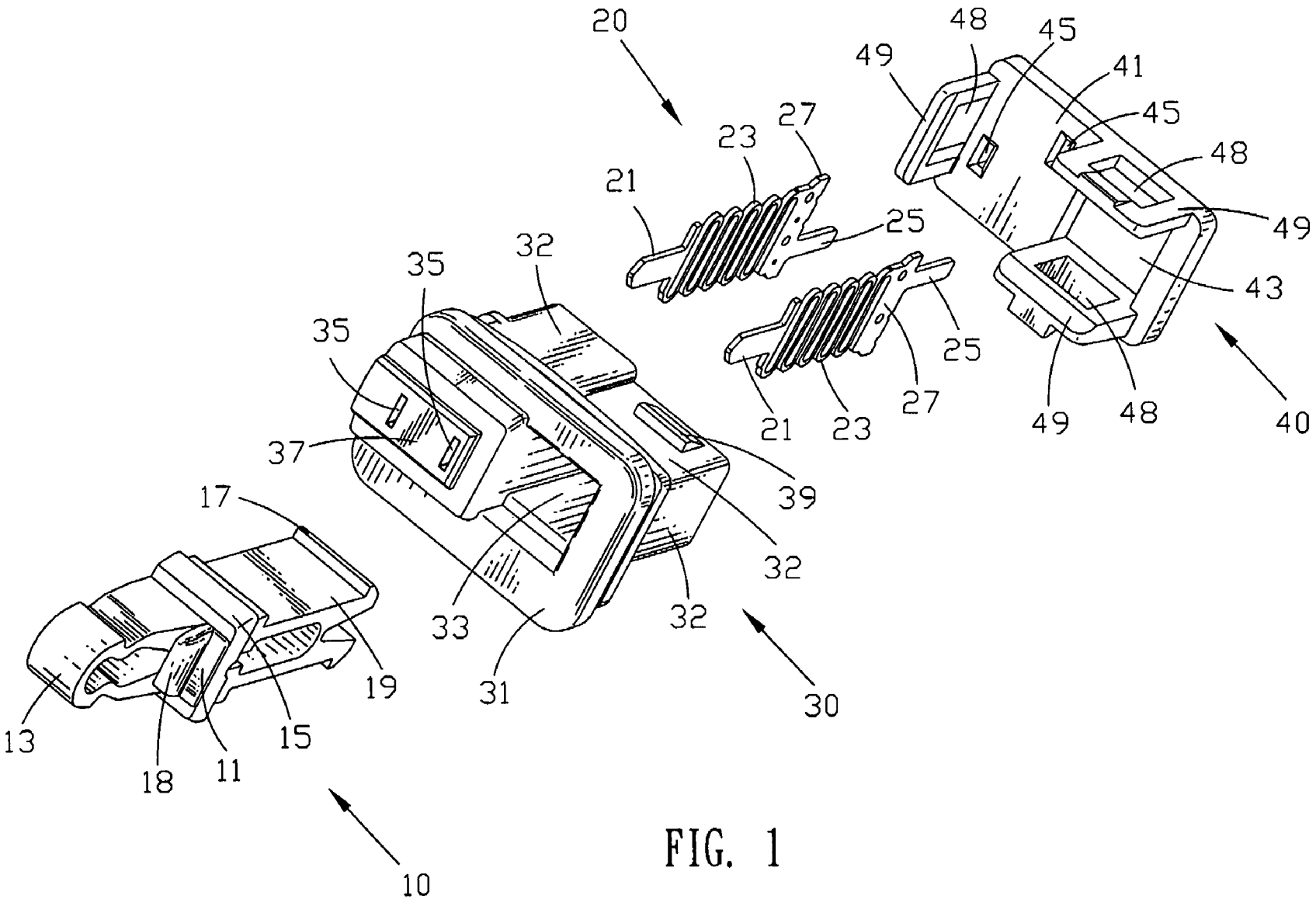
FIG. 1 is an exploded view of a plug connector according to the present invention.

With reference to FIG. 1, a plug connector 100 according to the present invention is illustrated, which includes a insulative plug housing 30, a cover 40 secured at the rear end of the insulative plug housing 30 and a locking member 10 and a plurality of spring contacts 20 accommodated in the insulative plug housing 30.

Figure 2:
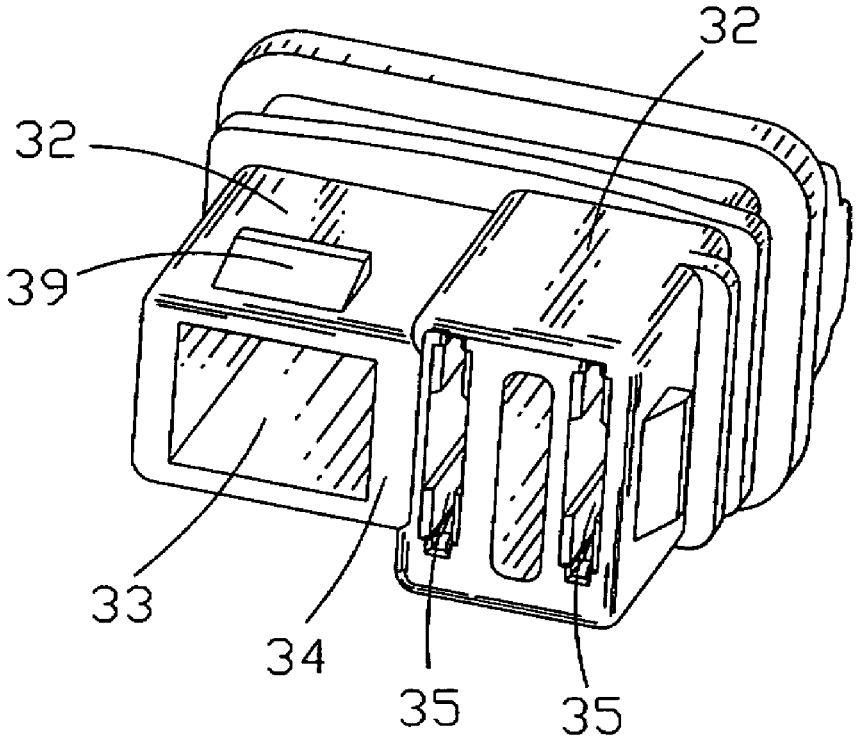
FIG. 2 is a perspective view of an insulative plug housing of the plug connector shown in FIG. 1.

Please refer to FIG. 1 and FIG. 2, the insulative plug housing 30 includes a front face 31, a plurality of lateral faces 32 which extend rearwards from the front face 31 ended up with a rear face 34 opposing to the front face 31, a cavity 33 extending rearwards from the front face 31 throughout the insulative plug housing 30 for receiving the locking member 10 therein, a first mating face 37 protruding forwards from the front face 31 abutting on the cavity 33, a plurality of contact passages 35 formed on the first mating face 37 lengthwise extending throughout the insulative plug housing 30 for receiving the respective spring contacts 20 therein and a plurality of latching tabs 39 formed on the lateral faces 32.

Figure 3:
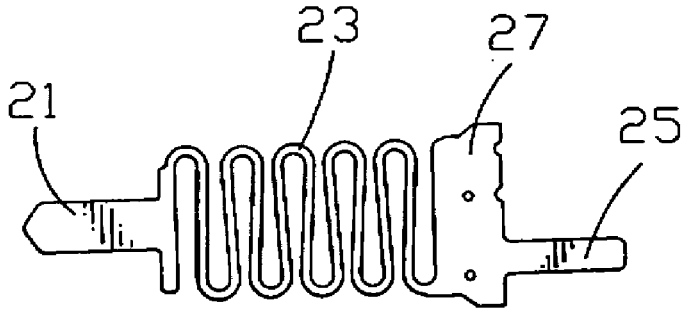
FIG. 3 is a perspective view of a spring contact of the plug connector.
Figure 4:
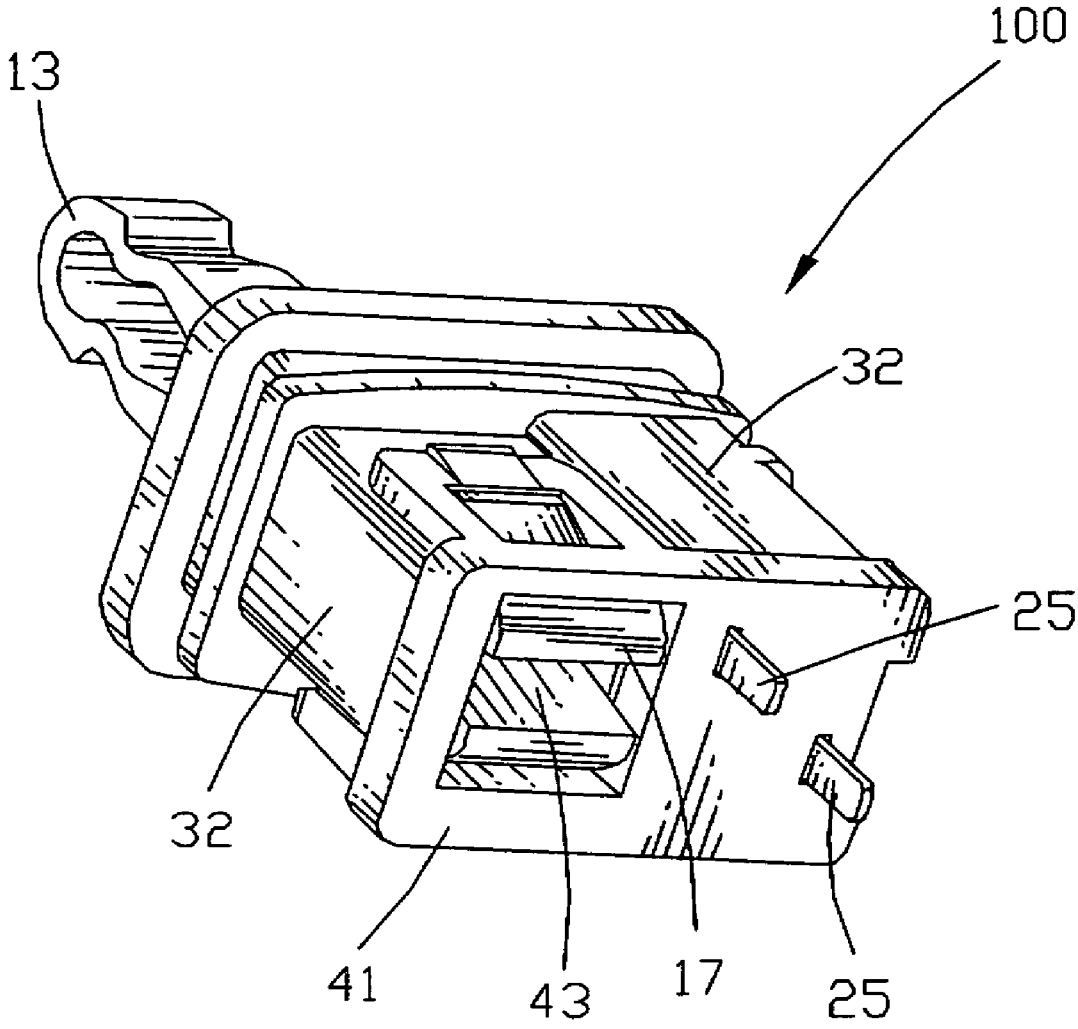
FIG. 4 is an assembled perspective view of the plug connector shown in FIG. 1.

Referring to FIG. 1 in conjunction with FIG. 3, each conductive spring contact 20 is accommodated in the respective contact passage 35 of the insulative plug housing 30. The spring contact 20 comprises a spring portion 23, a contact head 21 extending from a end of the spring portion 23, a secured portion 27 formed at another end of the spring portion 23 and a contact tail 25 projecting therefrom.

Referring to FIG. 1, the locking member 10 is disposed in the cavity 33 of the insulative plug housing 30. The locking member 10 comprises a base portion 19, a plurality of hamuluses 17 defined at the rear end of the base portion 19, a second mating face 15 formed at the front end of the base portion 19, a U-shaped locking arm 13 and a wedge 18 protruding forwards from the second mating face 15 and a pad 111 formed on the second mating face 15. The wedge 18 is located between the locking arm 13 and the pad 11. The wedge 18 makes the locking arm 13 locked in a corresponding receptacle connector tightly and firmly.

Referring to FIG. 1, the cover 40 which is secured at the rear end of the insulative plug housing 30 comprises a base board 41, a plurality of contact holes 45 which are defined in the base board 41 and allow the corresponding contact tails 25 of the spring contacts 20 to pass therethrough and make electrical connection with an external circuit (not shown), a plurality of latching boards 49 extending perpendicularly from the base board 41 and a through hole 43 defined in the base board 41 in position for receiving the rear end of the locking member 10 therein. Each latching board 49 has a latching hole 48 to receive the latching tabs 39 in order to engage the cover 40 and the insulative plug housing 30, Referring to FIG. 1, in conjunction with FIG. 2 and FIG. 3, in assembly, the spring contacts 20 are inserted into the respective contact passages 35 and the secured portion 27 fixed in the insulative plug housing 30 to firmly secured the spring contact 20 in the contact passage 35. Meanwhile, the contact head 21 and the contact tail 25 are exposed outside the insulative plug housing 30 for establishing electrical connection with the external circuit. The base portion 19 of the locking member 10 is disposed in the cavity 33 of the insulative plug housing 30 with the hamuluses 17 grasping the rear face 34. The second mating face 15 covers the front face 31 around the cavity 33 of the insulative plug housing 30 and abuts against the first mating face 37. Furthermore, the first mating face 37 and the second mating face 15 are in the same plane and constitute a mating face of the plug connector 100. Moreover, the locking arm 13 is positioned at the middle of the mating face and located between the contact passages 20 and pad 11. The latching tabs 39 of the insulative plug housing 30 are inserted into the respective latching holes 48 of the cover 40, as described hereinbefore, so that, the cover 40 is firmly secured at the rear end of the insulative plug housing 30. The contact tails 25 pass through the respective contact holes 45 in the base board 41 and are exposed outside the plug connector 100 for establishing electrical connection with the external circuit.

It will be appreciated that the locking member 10 is integrally molded with the insulative plug housing 30, then, the mating face which consists of the first mating face 37 and second mating face 15 protrudes forwards from the front face 31 with the locking arm 13 protruding therefrom.

Figure 5:
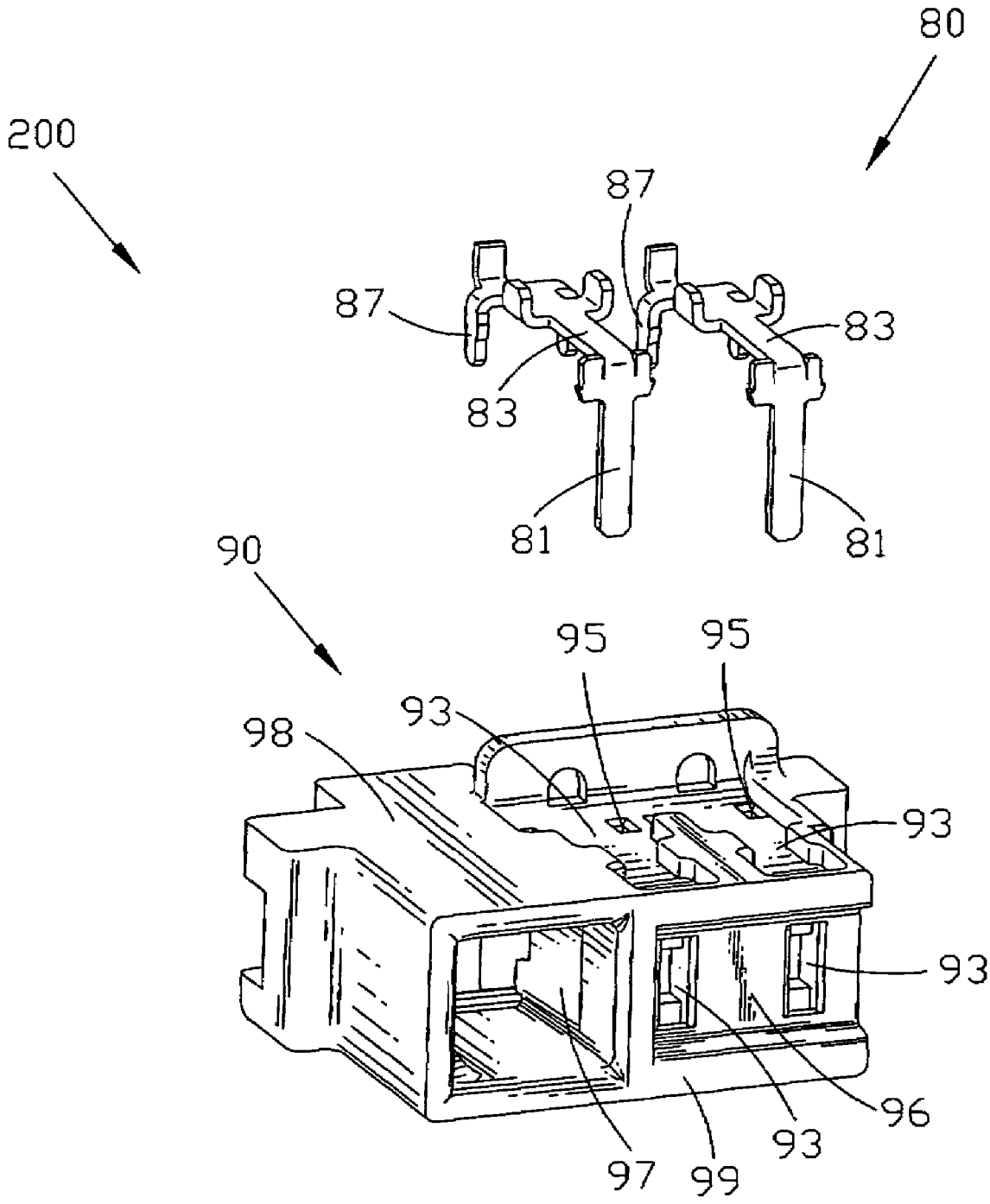
FIG. 5 is an exploded view of a complementary receptacle connector.

A complementary receptacle connector 200 is shown in FIG. 5. The receptacle connector 200 is complementally engaged with the plug connector 100 of the present invention. The receptacle connector 200 comprises an insulative receptacle housing 90 and a plurality of receptacle contacts 80 retained therein.

The insulative receptacle housing 90 has a guiding face 99 at the front end, a locking hole 97 extending rearwards from the guiding face 99 for receiving the locking arm 13 therein, a guiding opening 96 defined beside the locking hole 97 for receiving the first mating face 37, a plurality of restrict slots 93 formed lengthwise on a top surface 98 of the insulative receptacle housing 90 and extending downwards along the bottom side of the guiding opening 96 for receiving the receptacle contact 80 and a plurality of embedding holes 95 positioned beside the restrict slots 93 in the top surface 98.

Referring to FIG. 5, each receptacle contact 80 includes a base arm 83, a contact arm 81 extending downwards from the front end of the base arm 81 for making electrical connection with the respective contact head 21 of the spring contact 20, a plurality of embedding pins 87 projecting downwards from the base arm 83. The receptacle contacts 80 are secured in the insulative receptacle housing 90 by embedding the imbedding pins 87 into the respective embedded holes 95.

Figure 6:
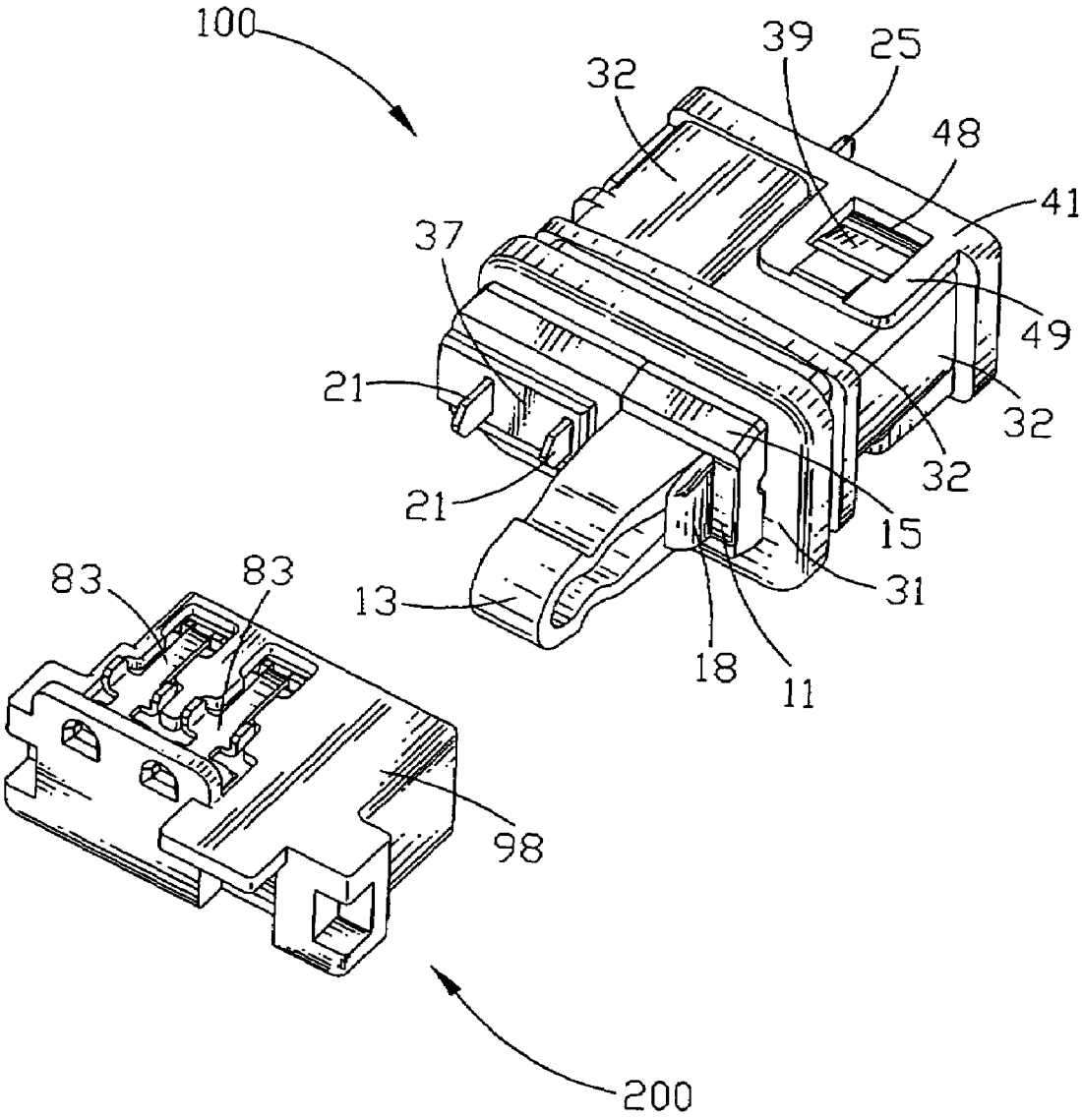
FIG. 6 is a perspective view showing the plug connector and the receptacle connector separated from each other.

Please referring to FIG. 5 and FIG. 6, in assembly, the contact arms 81 are inserted into the respective restricted slots 93 along the bottom side of the guiding opening 96. Meanwhile, the embedding pins 87 are inserted into the respective embedded holes 95, so that, the base arms 83 ride on the respective restricted slots 93 formed on the top surface 98 of the insulative receptacle housing 80.

Figure 7:
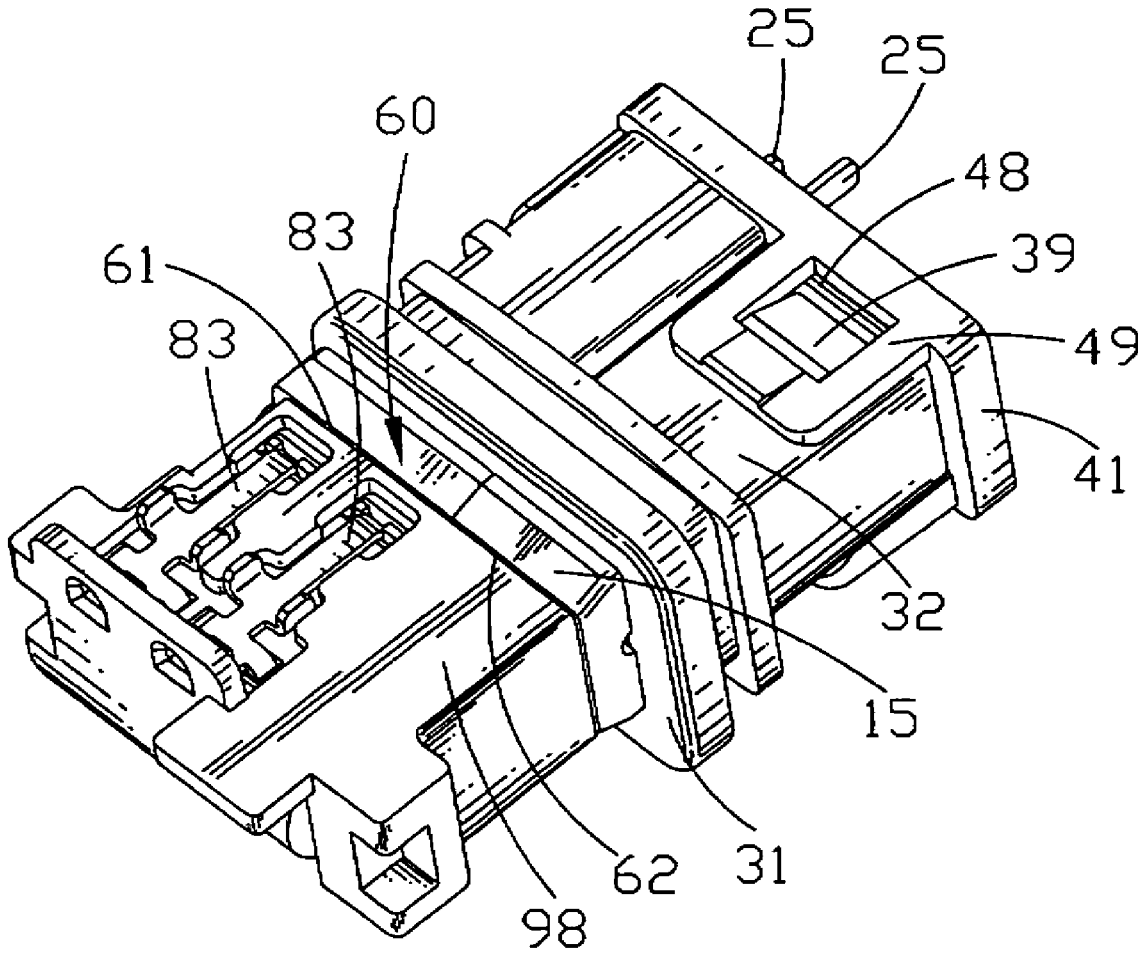
FIG. 7 is a perspective view showing the plug connector properly connected with the receptacle connector.
Figure 8:
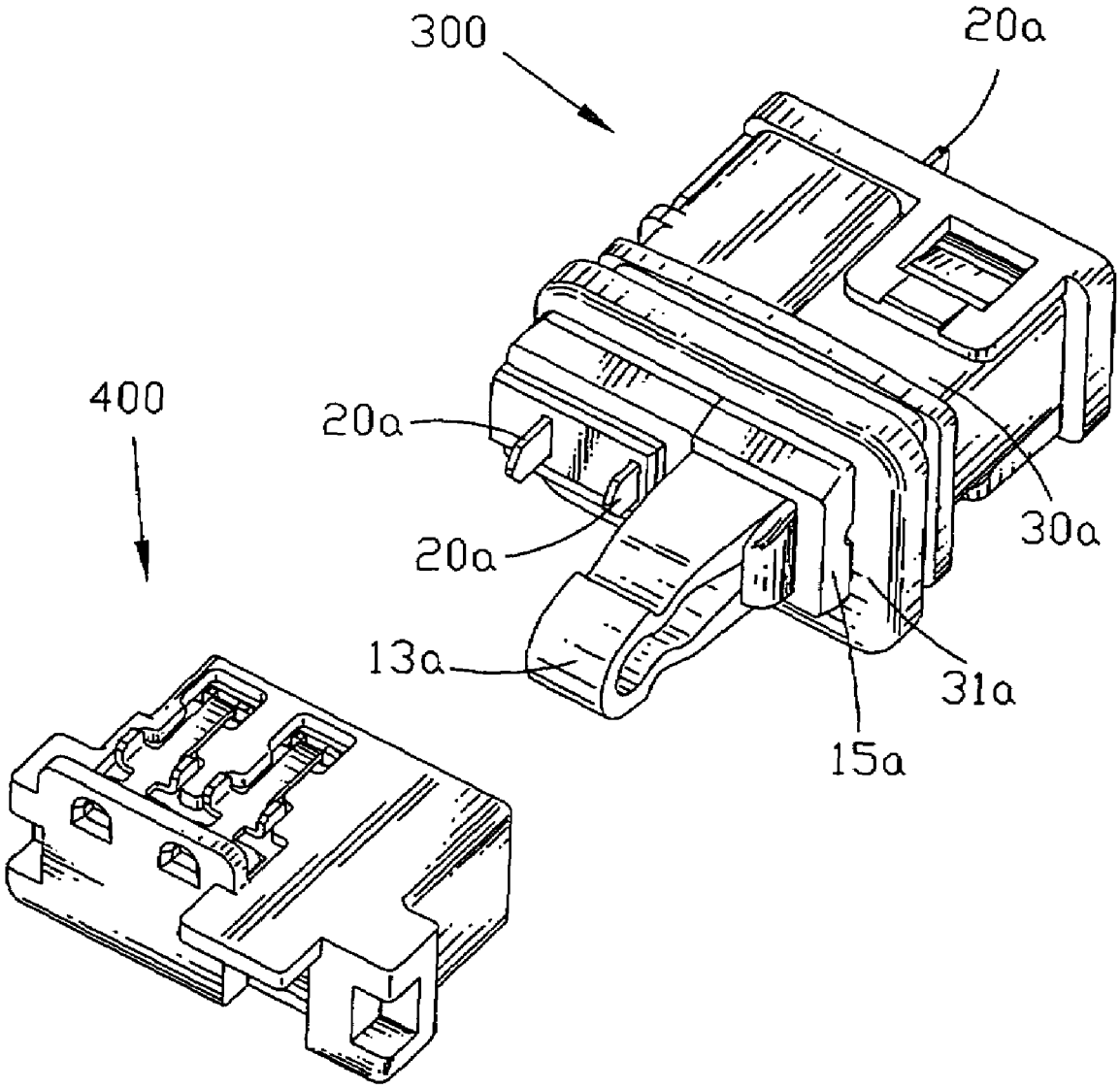
FIG. 8 (Prior Art)
FIG. 8 is a perspective view showing a conventional plug connector and a receptacle connector separated from each other.
Figure 9:
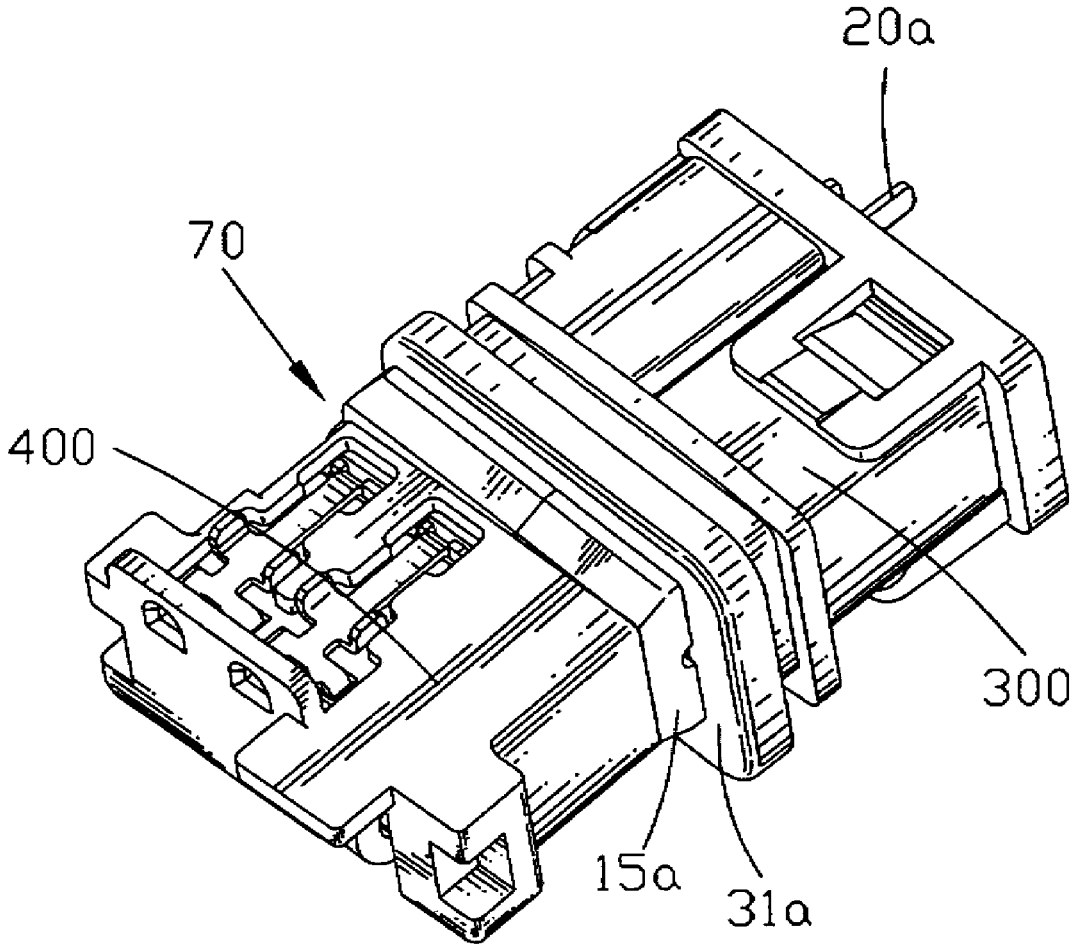
FIG. 9 (Prior Art)
FIG. 9 is a perspective view showing a conventional plug connector properly connected with the receptacle connector.

Referring to FIG. 6 and FIG. 7, when the plug connector 100 is connected with the receptacle connector 200, the locking arm 13 is locked in the locking hole 97. Therefore, the plug connector 100 is stuck to the receptacle connector 200. In addition, the wedge 18 is wedged into the locking hole 97 to effect a tight and firm connection between the plug connector 100 and the receptacle connector 200. The contact heads 21 of the spring contacts 20 are resiliently biased to the contact arms 81 of the respective receptacle contact 80 for establishing an electrical connection therebetween.

When the plug connector 100 is properly connected to the receptacle connector 200, the first mating face 37 bounds back under the elasticity of the spring contact 20 and keeps a first gap 61 to the guiding face 99 of the receptacle connector 200. In another hand, the pad 11 locates between the second mating face 15 of the plug connector 100 and the guiding face 99 of the receptacle connector 200 and keeps a second gap 61 therebetween. The first mating face 37 and the second mating face 15 constitutes the mating face of the plug connector 100, so that, the first gap 61 and the second gap 62 make up the gap between the mating face and the guiding face 99 of the receptacle connector 200. More particularly, the plug connector 100, the first mating face 37, the second mating face 15 and the locking arm 13 act as a lever and the locking arm 13 functions as a pivot of the lever. The plug connector 100 swings around the locking arm 13 relative to the receptacle connector 200. Therefore, the shape of the gap 60 between the plug connector 100 and the receptacle connector 200 can be changed by adjusting the thickness of the pad 11. In order to achieve a considerable electrical connection between the plug connector 100 and receptacle connector 200, the gap is shaped to be a rectangle. So that, the gap 60 looks tidy. Further more, the plug connector 100 is able to be connected to the receptacle connector 200 straightly. The spring contact 20 is provided with sufficient normal force to resiliently contact the respective respectable contact 80 and effects a stable electrical communication therebetween.

Although a preferred embodiment of the present invention has been described in detail hereinabove, it should be clearly understood that many variations and/or modifications of the basic inventive concepts herein taught which may appear to those skilled in the present art will fall within the spirit and scope of the present invention, as defined in the appended claims.

The invention claimed is:

1. A plug connector comprising an insulative housing, having a front face, a plurality of lateral faces extending from the front face and end up with a rear face, a first mating face protruding forwards from the front face and a plurality of contact passages extending from the first mating face;

a plurality of spring contacts retained in the respective contact passages, each spring contact having a spring portion, a contact head extending from the spring portion, a secured portion extending from the contact head and a contact tail formed at the rear end of the secured portion; and a locking member disposed in the insulative housing having a second mating face which covers on the front face of the insulative housing and abuts against the first mating face, a locking arm projecting from the second mating face and a pad formed on the second mating face, said pad is at a mid-portion of the locking member.

2. The plug connector as claimed in claim 1, said insulative housing further including a cavity defined at the front face and extending throughout said insulative housing; and the locking member further including a base portion retained in the cavity.

3. The plug connector as claimed in claim 1, the locking member further including a plurality of hamuluses defined at the rear end and clasping the rear face of said insulative housing.

4. The plug connector as claimed in claim 1, wherein a wedge protrudes from the second mating face abutting against the locking arm.

5. The plug connector as claimed in claim 1, further including a cover secured at the rear end of the insulative housing.

6. The plug connector as claimed in claim 5, wherein the cover includes a base board and a plurality of latching boards extending perpendicularly from the base board with a latching hole defined thereon, wherein a plurality of latching tabs are formed on the lateral face of the insulative housing and latched into the respective latching holes.

7. The plug connector as claimed in claim 1, wherein the locking member further including a base portion retained in the cavity, the pad being located between the base portion and the locking arm, the base portion and locking arm extending in a same direction.

8. The plug connector as claimed in claim 7, wherein the spring portion of the spring contacts have a nonlinear shape.

9. The plug connector as claimed in claim 7, wherein the spring portion of the spring contacts have a serpentine shape.

* * * * *